US007520821B2

(12) United States Patent
Cole

(10) Patent No.: US 7,520,821 B2
(45) **Date of Patent: *Apr. 21, 2009**

(54) GOLF CLUB HEAD AND METHOD OF MAKING SAME

(75) Inventor: Eric V. Cole, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/959,192

(22) Filed: Dec. 18, 2007

(65) Prior Publication Data

US 2008/0132354 A1 Jun. 5, 2008

Related U.S. Application Data

(63) Continuation of application No. 11/086,111, filed on Mar. 22, 2005, now Pat. No. 7,326,128.

(51) Int. Cl.
*A63B 53/04* (2006.01)

(52) U.S. Cl. ..... 473/335; 473/340; 473/341; 473/342; 473/409

(58) Field of Classification Search ..... 473/324–350, 473/409

See application file for complete search history.

(56) References Cited

U.S. PATENT DOCUMENTS

| | | | |
|---|---|---|---|
| 1,449,559 | A | 3/1923 | So Relle |
| 1,494,494 | A | 5/1924 | Lippincott |
| 1,654,257 | A | 12/1927 | Hillerich |
| 2,781,197 | A | 2/1957 | Wiley |
| 4,213,613 | A | 7/1980 | Nygren |
| 4,508,350 | A | 4/1985 | Duclos |
| 4,655,459 | A | 4/1987 | Antonious |
| 4,915,385 | A | 4/1990 | Anderson |
| 4,934,703 | A | 6/1990 | Delaney |
| 5,246,227 | A | 9/1993 | Sun et al. |
| 5,375,583 | A | 12/1994 | Meyer et al. |
| 5,390,919 | A | 2/1995 | Stubbs et al. |
| 5,464,215 | A | 11/1995 | Koehler |
| 5,564,705 | A | 10/1996 | Kobayashi et al. |
| 5,575,472 | A | 11/1996 | Magerman et al. |
| 5,580,058 | A | 12/1996 | Coughlin |
| 5,593,356 | A | 1/1997 | Takeda |
| 5,613,917 | A | 3/1997 | Kobayashi et al. |
| 5,707,299 | A | 1/1998 | McKenna |

(Continued)

OTHER PUBLICATIONS

"Mass, Weight, Density or Specific Gravity of Bulk Materials", SI metric [online], pp. 1-9 [retrieved on Dec. 18, 2007]. Retrieved from the Internet: <URL: http://www.simetric.co.uk/si_materials.htm>.

(Continued)

*Primary Examiner*—Sebastiano Passaniti

(57) ABSTRACT

A golf club head, preferably a putter head, has a body fitted with inserts having a density greater than that of the club head body. Two cavities are formed in the body. One cavity is adjacent a heel region of the body, and the other cavity is adjacent a toe region of the body. In a preferred embodiment, the inserts and the cavities are provided with a suitable draft angle. The inserts are bonded within the cavities and are subsequently finished using a milling process or the like so that a front surface of each insert is substantially flush with the front face of the body.

27 Claims, 3 Drawing Sheets

U.S. PATENT DOCUMENTS

| | | | | |
|---|---|---|---|---|
| 5,839,974 | A | 11/1998 | McAllister | |
| 5,947,841 | A | 9/1999 | Silvestro | |
| 5,964,669 | A | 10/1999 | Bloomer | |
| 6,290,609 | B1 | 9/2001 | Takeda | |
| 6,435,979 | B1 | 8/2002 | Mounfield, Jr. | |
| 6,902,496 | B2 | 6/2005 | Solheim et al. | |
| 6,974,394 | B1 | 12/2005 | Tang et al. | |
| 7,037,211 | B1 | 5/2006 | Kosovac | |
| 7,056,227 | B2 | 6/2006 | Giraldi | |
| 7,326,128 | B2 * | 2/2008 | Cole | 473/335 |
| 2002/0193176 | A1 | 12/2002 | Grace | |

OTHER PUBLICATIONS

"Mass, Weight, Density or Specific Gravity of Wood", SI metric [online], pp. 1-3 [retrieved on Dec. 12, 2007]. Retrieved from the Internet: <URL: http://www.simetric.co.uk/si_wood.htm>.

* cited by examiner

GOLF CLUB HEAD AND METHOD OF MAKING SAME

This application is a continuation of application Ser. No. 11/086,111 filed Mar. 22, 2005.

BACKGROUND OF THE INVENTION

This invention relates generally to golf equipment and, in particular, to a golf club head and a method of making tine golf club head.

It is often desirable to incorporate heel and toe weighting into a golf club head to increase the moment of inertia of the club head. This increased moment of inertia tends to decrease club head twisting in the event the golfer strikes the golf bail off-center. In an effort to increase the moment, of inertia, prior art club heads generally utilize a low-density material (such as aluminum) for a club head body in conjunction with a higher density material for heel and toe weights. U.S. Pat. No. 4,508,350, for example, discloses a golf club putter having a high polar moment of inertia provided by forming the club head body of aluminum. Similarly, U.S. Pat. No. 4,915,385 discloses metallic (e.g., copper) heel and toe weights used in conjunction with a lower-density (e.g., aluminum) club head.

DESCRIPTION OF THE INVENTION

Figure 1:
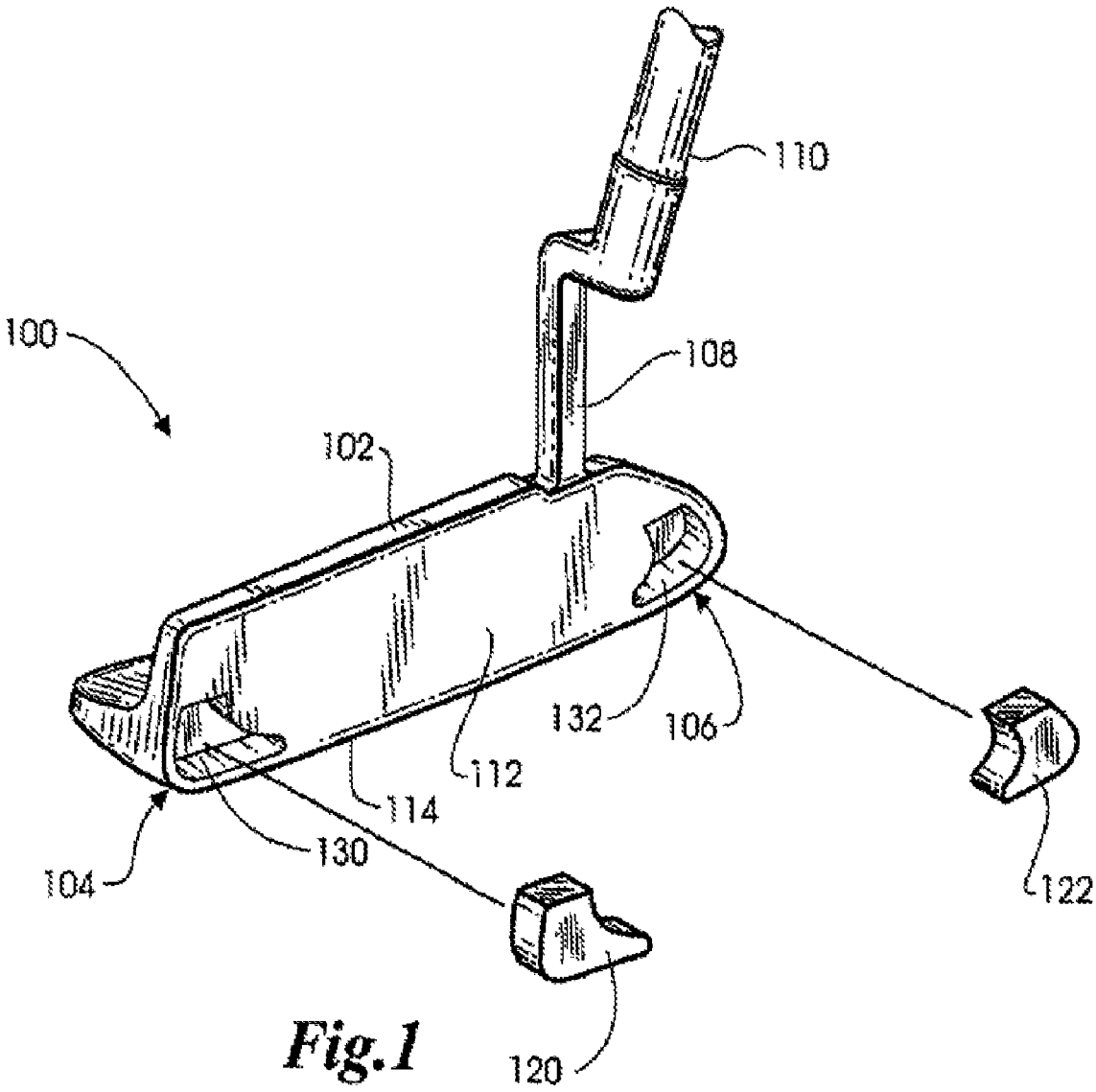
FIG. 1 is an exploded perspective view of a golf club head in accordance with the present invention.

With reference to FIG. 1, a golf club head 100, preferably a golf putter head, in accordance with a preferred embodiment of the present invention includes a body 102 having a front face 112, a bottom surface or "sole" 114, a heel region 106, and a toe region 104. Body 102 is typically attached to a shaft. 110 via a suitable hose1 108 and is suitably formed such that it includes two cavities (or "pockets") 130 and 132 located in toe and heel regions 104 and 106, respectively. Inserts 120 and 122 are configured to be received within, attached to, or otherwise integrated with body 102 such that they substantially fill the respective cavities 130 and 132.

In the preferred embodiment, cavities 130 and 132 are configured to receive the respective inserts 120 and 122 only through openings in front face 112, and are held in place via any suitable bonding technique—e.g., epoxy, interference fit, or the like. In the preferred embodiment, cavities 130 and 132 (as well as inserts 120 and 122) are formed with a suitable "draft" (e.g., a five degree draft) to facilitate placement of inserts 120 and 122, as described in further detail below. Further in accordance with the preferred embodiment, after inserts 120 and 122 are placed in cavities 130 and 132, the front surfaces 214 (FIG. 2A) of inserts 120 and 122 are milled or otherwise finished so that these front surfaces 214 are flush with lace 112.

Body 102 generally comprises any suitable metal, plastic, composite material, or combination thereof selected in accordance with various criteria as described in further detail below. For example, body 102 may be made of a metallic material having a relatively low density, e.g., titanium or a high-purity titanium alloy having a density of approximately 3.0 g/cm$^3$ to 7.0 g/cm$^3$. Alternatively, the body 102 may be made of a composite or plastic material having the desired characteristics. Depending upon the selected material or materials, body 102 may be fabricated using any suitable process now known or later developed, including a variety of conventional casting methods such as investment-casting, powdered-metal processing, and/or metal machining. Body 102 is preferably formed using a suitable casting process and thereafter milled to finish the various exposed surfaces, as described in further detail below.

In the preferred embodiment, cavities 130 and 132 are configured with respect to body 102 such that inserts 120 and 122 form a portion efface 112 of body 102 and are placed at the opposite ends of body 102, i.e. in the heel and toe regions 106 and 104 of the body 102. This placement of the inserts 120, 122 increases the moment of inertia of club head 100 when inserts 120 and 122 are fabricated from a material having a density that is greater than that of body 102. In this regard, inserts 120 and 122 may be fabricated using any suitable material, including various metals, plastics, composite materials, or any combination thereof. In the preferred embodiment, inserts 120 and 122 are formed of a material such as tungsten having a density ranging from approximately 15.0 g/cm$^3$ to 20.0 g/cm$^3$.

It is usually advantageous to fit club head 100 with inserts 120 and 122 having substantially the same weight. The present invention, however, also contemplates the use of inserts 120 and 122 having different weights and/or manufactured from different materials. This might be advantageous, for example, to compensate for non-symmetrical features of club head 100 or to align the center of gravity of club head 100 with the geometric center of front face 112. Inserts 120 and 122 may be fixed within respective cavities 130 and 132 using any suitable method now known or later developed, including the use of adhesives and/or conventional metal-joining operations such as soldering, brazing, and the like. In the preferred embodiment, inserts 120 and 122 are affixed within cavities 130 and 132 by using a conventional epoxy adhesive.

Figure 2A:
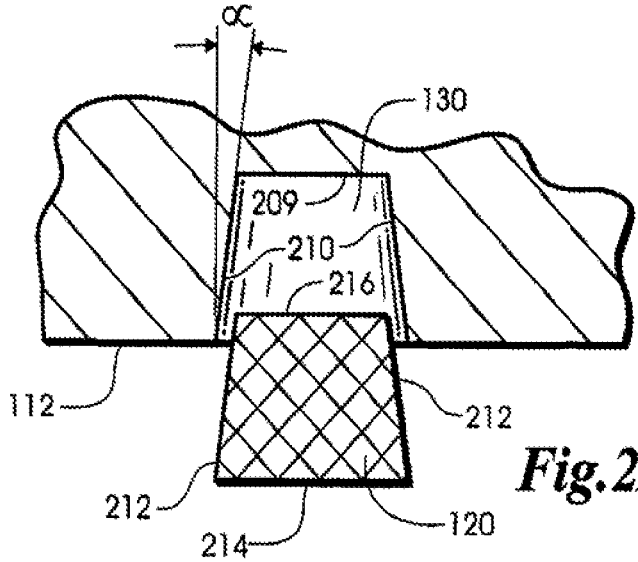
FIGS. 2A, 2B and 2C are enlarged cross sectional views showing a portion of the golf club head shown in FIG. 1.
Figure 2B:
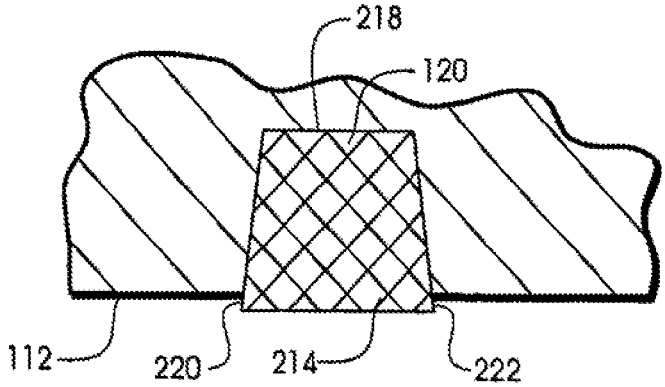
Figure 2C:
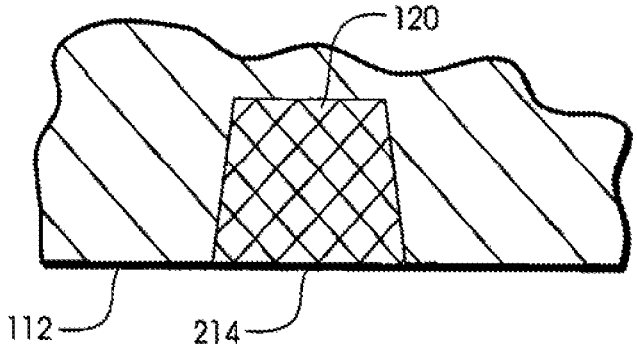

FIGS. 2A, 2B and 2C depict the placement of insert 120 within cavity 130, as seen in a cross sectional view. As shown in FIG. 2A, cavity 130 has a bottom wall 209 and side walls 210. In the preferred embodiment, the side walls 210 are provided with a draft angle alpha, (e.g., a draft angle of approximately five degrees). It will be appreciated that the mating side surfaces 212 of insert 120 would have the same draft angle. Insert 120 also has a bottom surface 216. As shown in FIG. 2B, insert .120 is suitably placed within cavity 130 such that, it substantially fills the cavity 130 In the preferred embodiment, a layer 218 of epoxy adhesive is applied to the bottom wall 209 and the side walls 210 of cavity 130 in order to provide permanent bonding of the insert 120 within cavity 130, It will be understood that portions of the front surface 214 of insert 120 may not be flush (e.g., at points 220 and 222 in FIG. 2B) with respect to front face 112 of the body 1.02. Accordingly, the surface 214 is preferably milled or otherwise finished so that the surface 214 as shown in FIG. 2C is flush with front face 112. It will be appreciated that the steps illustrated in FIGS. 2A-2C would also be performed for the insert 122.

Figure 3:
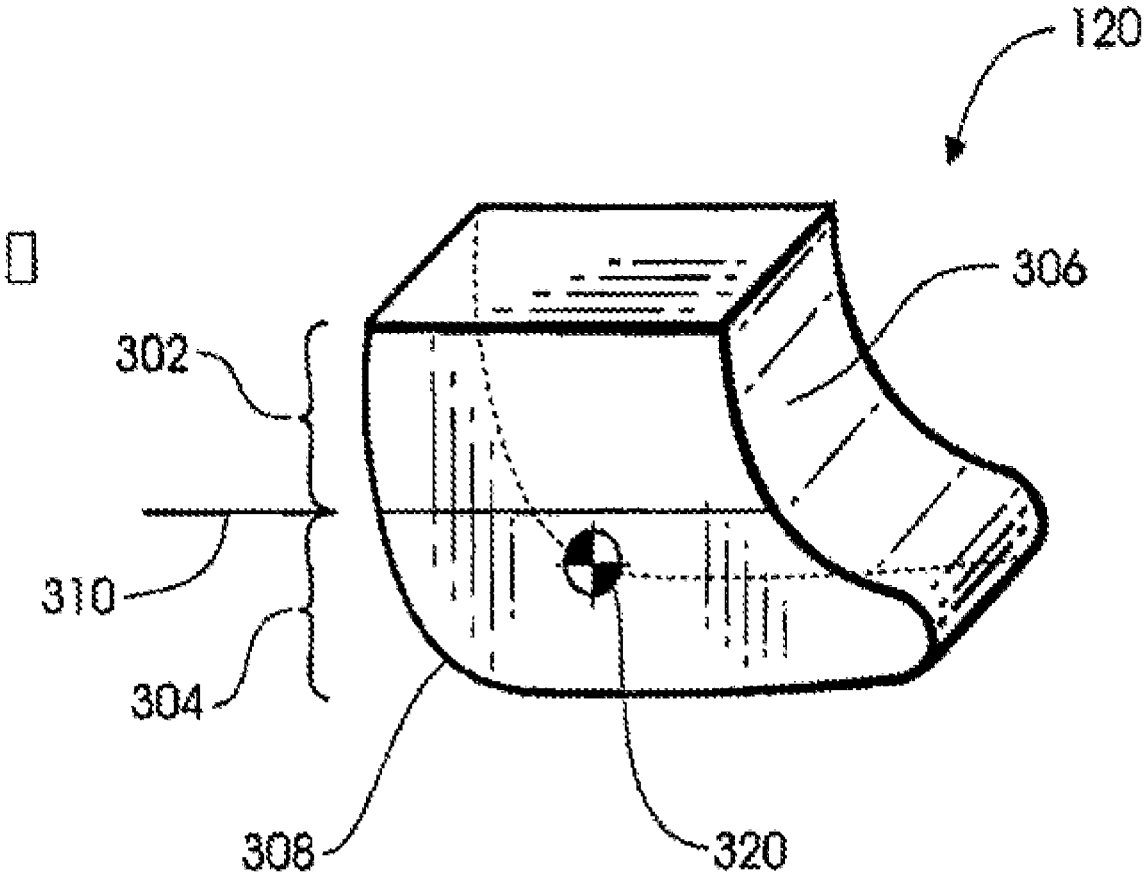
FIG. 3 is an enlarged perspective view of a portion of the golf club head of FIG. 1.

FIG. 3 shows the insert 120 as having an inner arcuate surface 306 and an outer arcuate surface 308. It will be understood that the outer arcuate surface 308 generally follows the contour of the toe region 104 of the body 102. The insert 120 is preferably configured such that there is more mass in portion 304 that is below vertical midline 310 than in the portion 302 that is above vertical midline 310. It is preferable that, given the total height of insert 120 (as viewed from the front relative to the body 102), the insert weight is concentrated such that the center of gravity 320 of insert 120 is below vertical midline 310. This configuration of insert 120 assists in lowering the center of gravity of the club head 100.

Although the invention has been described herein in conjunction with the appended drawings, those skilled in the art will appreciate that the scope of the invention is not so limited. For example, while the present invention has been described in terms of golf putters, many other types of golf clubs would profit from the present invention, including irons, metal woods, etc. Moreover, while titanium and tungsten have been cited as preferred materials for the body and inserts respectively, it will be appreciated that any suitable material now known or later developed may be used in connection with the present invention, including various metals, alloys., composites, ceramics, and the like. These and other modifications in the selection, design, and arrangement of the various components and steps discussed herein may be made without departing from the scope of the invention as set forth in the appended claims.

What is claimed is:

1. A method of manufacturing a golf club head, comprising:

forming a body having a heel region, a toe region, a front face, a first cavity in the heel region, and a second cavity in the toe region;

forming a first insert and a second insert;

placing the first insert within the first cavity;

placing the second insert within the second cavity; and forming each of the first and second inserts with a height and a horizontal midline perpendicular to the height so that a portion of each of the inserts located below the horizontal midline comprises a volume greater than a portion of each of the inserts located above the horizontal mid line;

wherein:

the first and second cavities are accessible only through the front face of the body;

forming the body comprises:

forming one or more sidewalls of the first cavity to be angled at a first draft angle; and forming one or more sidewalls of the second cavity to be angled at a second draft angle;

and forming the first insert and the second insert comprises:

forming one or more sidewalls of the first insert to be angled for correspondingly mating with the one or more sidewalls of the first cavity; and forming one or more sidewalls of the second insert to be angled for correspondingly mating with the one or more sidewalls of the second cavity.

2. The method of claim 1, further comprising affixing the first and second inserts within the first and second cavities by using adhesive.

3. The method of claim 1, further comprising finishing front surfaces of the first and second inserts to be substantially flush with the front face by utilizing a milling process.

4. The method of claim 1 wherein:

forming the body further comprises forming each of the first and second cavities with a bottom wall, and forming the first insert and the second insert further comprises forming each of the first and second inserts with a bottom surface.

5. The method of claim 4, further comprising applying a layer of adhesive to the bottom wall and the side walls of the first and second cavities before the first and second inserts are placed in the first and second cavities.

6. The method of claim 1, wherein at least one of the first draft angle or the second draft angle is approximately 5°.

7. The method of claim 1, wherein forming the body further comprises forming the body from a first material having a first density, wherein forming the first insert and the second insert further comprises forming the first and second inserts from a second material having a second density, and wherein the second density is greater than the first density.

8. The method of claim 7, wherein forming the body further comprises providing the second density at a ratio of at least 2.5:1 with respect to the first density.

9. The method of claim 1, wherein forming the first and second inserts further comprises forming each of the first and the second inserts with a perimeter having a partial convex surface and a partial concave surface.

10. The golf club head of claim 1, further comprising a layer of adhesive on the side walls of the first and second cavities to bond the first and second inserts in the first and second cavities.

11. The golf club head of claim 1, wherein the first and second cavities each have a bottom wall, and wherein the first and second inserts each have a bottom surface.

12. The golf club head of claim 1, wherein at least one of the first draft angle or the second draft angle is about 5°.

13. The method of claim 1, wherein:

each of the one or more sidewalls of the first cavity comprises the first draft angle;

each of the one or more sidewalls of the first insert comprises the first draft angle;

each of the one or more sidewalls of the second cavity comprises the second draft angle; and each of the one or more sidewalls of the second insert comprises the second draft angle.

14. The method of claim 1, wherein: the first draft angle is substantially similar to the second draft angle.

15. A golf club head comprising:

a body comprising a heel region, a toe region, a front face, a first cavity in the heel region, and a second cavity in the toe region;

and a first insert and a second insert located in the first and second cavitics, respectively;

wherein:

each of the first and second inserts has a height and a horizontal midline perpendicular to the height so that a portion of each of the inserts located below the horizontal midline has a mass greater than a portion of each of the inserts located above the horizontal midline;

the first and second cavities are accessible only through the front face of the body;

one or more sidewalls of the first cavity are angled at a first draft angle;

one or more sidewalls of the first insert are angled to correspondingly mate with the one or more sidewalls of the first cavity;

one or more sidewalls of the second cavity are angled at a second draft angle; and one or more sidewalls of the second insert are angled to correspondingly mate with the one or more sidewalls of the second cavity.

16. The golf club head of claim 15, wherein the body is formed of a first material having a first density, wherein the first and second inserts are formed of a second material having a second density, and wherein the second density is greater than the first density.

17. The golf club head of claim 16, wherein the second density has a ratio of at least 2.5:1 with respect to the first density.

18. The golf club head of claim 15, wherein each of the first and second inserts comprises a front surface that is substantially flush with the front face of the body.

19. The golf club head of claim 15, wherein each of the first and second inserts comprises a perimeter having a partial convex surface and a partial concave surface.

20. The golf club head of claim 15, wherein:

each of the one or more sidewalls of the first cavity comprises the first draft angle;

each of the one or more sidewalls of the first insert comprises the first draft angle;

each of the one or more sidewalls of the second cavity comprises the second draft angle; and each of the one or more sidewalls of the second insert comprises the second draft angle.

21. The golf club head of claim 15, wherein the first draft angle is substantially similar to the second draft angle.

22. A method of manufacturing a golf club comprising:

forming a body having a heel region, a toe region, a front face, a first cavity adjacent the heel region, and a second cavity adjacent the toe region, wherein the first and second cavities are accessible only through the front face of the body, wherein each of the first and second cavities has a plurality of side walls, and wherein the side walls of the first and second cavities have a draft angle;

forming a first insert and a second insert, each insert having a plurality of side surfaces for mating with the side walls of the first and second cavities, wherein the side surfaces of the first and second inserts have the draft angle; and wherein each of the first and second inserts comprises a height and a horizontal midline perpendicular to the height so that a portion of each of the first and second inserts located below the horizontal midline comprises a volume greater than a portion of each of the inserts located above the horizontal midline;

placing and affixing the first insert within the first cavity, wherein the center of mass of the first insert lies below a horizontal midline of the body;

placing and affixing the second insert within the second cavity, wherein the center of mass of the second insert lies below the horizontal midline of the body;

and coupling the body to a shaft.

23. The method of claim 22, further comprising finishing front surfaces of the first and second inserts by utilizing a milling process so that the front surfaces of the first and second inserts are substantially flush with the front face.

24. The method of claim 22, wherein forming the body further comprises forming the body from a first material having a first density, wherein forming the first and second inserts comprises forming the first and second inserts from a second material having a second density, and wherein the second density is greater than the first density.

25. The method of claim 24, wherein forming the first and second inserts further comprises forming each of the first and the second inserts from the second material having the second density in a ratio at least 2.5:1 to the first density.

26. The method of claim 22, wherein forming the first and second inserts further comprises forming each of the first and the second inserts with a perimeter having a partial convex surface and a partial concave surface.

27. The method of claim 22, wherein the draft angle of the side walls of the cavities is about 5°.

* * * * *

UNITED STATES PATENT AND TRADEMARK OFFICE

CERTIFICATE OF CORRECTION

PATENT NO. : 7,520,821 B2
APPLICATION NO. : 11/959192
DATED : April 21, 2009
INVENTOR(S) : Eric V. Cole It is certified that error appears in the above-identified patent and that said Letters Patent is hereby corrected as shown below:

Column 3, line 36 (Claim 1), delete "mid line;" and insert --midline;-- after the text reading "horizon-tal"

Column 3, line 60 (Claim 4), delete "claim 1" and insert --claim 1,-- after the text reading "the method of"

Column 4, line 45 (Claim 15), delete "cavitics," and insert --cavities,-- after the text reading "second"

Signed and Sealed this

Twenty-sixth Day of January, 2010

David J. Kappos

David J. Kappos
*Director of the United States Patent and Trademark Office*